US010357427B1

(12) United States Patent
Le et al.

(10) Patent No.: US 10,357,427 B1
(45) Date of Patent: Jul. 23, 2019

(54) AIR MASSAGE DEVICE FOR PEDICURE SPA AND METHOD

(71) Applicants: Kevin Le, Richland Hills, TX (US); Thanh Le, Arlington, TX (US)

(72) Inventors: Kevin Le, Richland Hills, TX (US); Thanh Le, Arlington, TX (US)

( * ) Notice: Subject to any disclaimer, the term of this patent is extended or adjusted under 35 U.S.C. 154(b) by 0 days.

(21) Appl. No.: 16/276,351

(22) Filed: Feb. 14, 2019

(51) Int. Cl.
*A61H 33/00* (2006.01)
*A61H 33/02* (2006.01)
*A61H 35/00* (2006.01)

(52) U.S. Cl.
CPC ..... *A61H 33/6026* (2013.01); *A61H 33/6042* (2013.01); *A61H 33/6047* (2013.01); *A61H 33/6063* (2013.01); *A61H 35/006* (2013.01); *A61H 2033/0083* (2013.01); *A61H 2033/023* (2013.01); *A61H 2201/5058* (2013.01)

(58) Field of Classification Search
CPC ..... A61H 33/6026; A61H 35/006; A61H 33/6063; A61H 33/6047; A61H 33/6042; A61H 2033/0083; A61H 2201/5058; A61H 2033/023
See application file for complete search history.

(56) References Cited

U.S. PATENT DOCUMENTS 4,510,967 A * 4/1985 Spinnett ..... A61H 33/60 137/115.02
5,495,627 A * 3/1996 Leaverton ..... A61H 33/027 239/413
2009/0089924 A1* 4/2009 Jan ..... A61H 33/025 4/541.5
2013/0096490 A1* 4/2013 Pelkus ..... A61H 9/0021 604/24
2014/0259374 A1* 9/2014 Ta ..... A61H 35/006 4/621
2016/0348681 A1* 12/2016 Le ..... F04D 25/026
2017/0074260 A1* 3/2017 Yan ..... F04B 43/021
2017/0156980 A1* 6/2017 Ta ..... A61H 35/006

* cited by examiner

*Primary Examiner* — Quang D Thanh
(74) *Attorney, Agent, or Firm* — Law Office of Jeff Williams PLLC; J. Oliver Williams

(57) ABSTRACT

An air pump for dispensing air massage therapy to a basin is provided. It may be used and with a disposal liner. The air pump includes a motor, an air generator, a mounting housing member, a gasket or seal, and an air nozzle. The air pump assembly includes the air pump and the air dispenser. The air pump preferably also includes a printed circuit board (PCB), a PCB cover, an LED light, an infrared light, and a contact-less fluid sensor. The present invention is also directed to a pump apparatus that includes an air pump as described, a power source, and/or a control apparatus.

30 Claims, 11 Drawing Sheets

AIR MASSAGE DEVICE FOR PEDICURE SPA AND METHOD

BACKGROUND

1. Field of the Invention

The present invention generally relates to spa devices, components, and systems. More specifically, the present invention is directed to an air pump assembly that is designed and configured to be mounted to the wall of a basin for providing air massage therapy to a user. It may be used with a disposable liner.

2. Description of Related Art

Spa devices, components, and systems are known in the art. Spa devices are used in commercial and recreational settings for hydrotherapy, massage, stimulation, pedicure, and bathing purposes. In the spa application setting, the issues with sanitization in the spa industry today require the use of a liner, such as a disposable liner. But with a liner, traditional water sensors in spa devices and settings, such as foot spas, will not be able to effectively detect fluids or water anymore. Thus, there exists a need for a pump having a contactless, fluid sensor adapted for use with a liner for dispensing a fluid to a setting such that fluid or water level can be effectively detected in a setting, such as, but not limited, a foot spa, a spa, a jacuzzi, a bathtub, or a swimming pool.

In addition, typical spa devices include a motor that drives a pump to circulate water from the spa device. In particular, a shaft of the motor is used to directly mount an impeller, which is then used to circulate water into and out of the spa device. Since the motor may not operate wet, a seal or a series of seals may be required to prevent water from entering the motor. The seals will wear to the point where water will enter the motor and consequently, the entering water may cause the motor to burn out. At this point, the motor assembly will need to be replaced in order to continue operation. This is expensive and may take several hours in which to perform.

Further, because typical spa devices have extensive piping systems that are built into the spa device to transport air and water, the spa devices are traditionally difficult to clean. This results in downtime and complicated maintenance schedules to clean such spa devices. Furthermore, if a spa device has a light source associated with it, to replace or repair such a light source can be time consuming and complicated when the light source is not easily accessible.

Additionally, for magnetic coupling-type pumps, it is almost impossible to have a perfect alignment between the motor shaft axis and the impeller rotation axis. The imperfect alignment or misalignment will result in high vibration noise.

The present invention overcomes one or more of the shortcomings of the above described spa devices, components, and systems. The Applicant is unaware of inventions or patents, taken either singly or in combination, which are seen to describe the present invention as claimed.

Although strides have been made to improve spa devices, components, and systems, shortcomings remain. It is desired that an air pump mechanism be combined with a mounting housing for the dispersion of air into a foot basin with a removable liner and/or an air dispenser.

SUMMARY OF THE INVENTION

In one exemplary aspect, the present invention is directed to an air massage device for dispensing air to a setting or work environment in the manicure and pedicure industries. The air massage device includes an air pump mechanism for creating air flow. The air pump is designed and configured to be mounted on a sidewall of a foot basin. A mounting housing is also included and has a top surface, a bottom surface, and a shoulder dimensioned and configured to mount to the sidewall of the foot basin in the manicure and pedicure industries. An air nozzle extends from top surface of the mounting housing to dispend air into the basin. The air dispenser being submerged in water.

In another exemplary aspect, the present invention is directed to an air massage device for dispensing air to a setting or work environment in the manicure and pedicure industries wherein the air massage device further includes a disposable air dispenser to distribute air to the foot basin.

In yet another exemplary aspect, the present invention is directed to a pedicure spa basin including a spa basin, an air pump mechanism, a mounting housing, an air nozzle, and a disposable air dispenser. The spa basin includes an air massage device and a drain hole. The air massage device includes an air pump mechanism for creating air flow. A mounting housing is also included and is configured to mount to a sidewall of the basin in the manicure and pedicure industries. An air nozzle extends from a top surface of the mounting housing to dispend air into the basin. Additionally, a disposable air dispenser is used to distribute air to the basin.

The pump may further comprise a power source for providing power to the pump and/or a control apparatus.

Additionally, the pump may include a contactless fluid sensor assembly with a contactless fluid sensor for dispensing a fluid to a setting and for use with a liner. The contactless fluid sensor assembly may include a contactless fluid sensor or sensor circuit board, and may also include a sensor cover and a sensor output data cable.

In a further exemplary aspect, the present invention is directed to a method for dispensing air to a pedicure spa basin using an air pump and a disposable air dispenser.

The more important features of the system have thus been outlined in order that the more detailed description that follows may be better understood and to ensure that the present contribution to the art is appreciated. Additional features of the system will be described hereinafter and will form the subject matter of the claims that follow.

Many objects of the present system will appear from the following description and appended claims, reference being made to the accompanying drawings forming a part of this specification wherein like reference characters designate corresponding parts in the several views.

Before explaining at least one embodiment of the system in detail, it is to be understood that the assembly is not limited in its application to the details of construction and the arrangements of the components set forth in the following description or illustrated in the drawings. The assembly is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present system. It is important, therefore, that the claims be regarded as including such equivalent constructions insofar as they do not depart from the spirit and scope of the present system.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
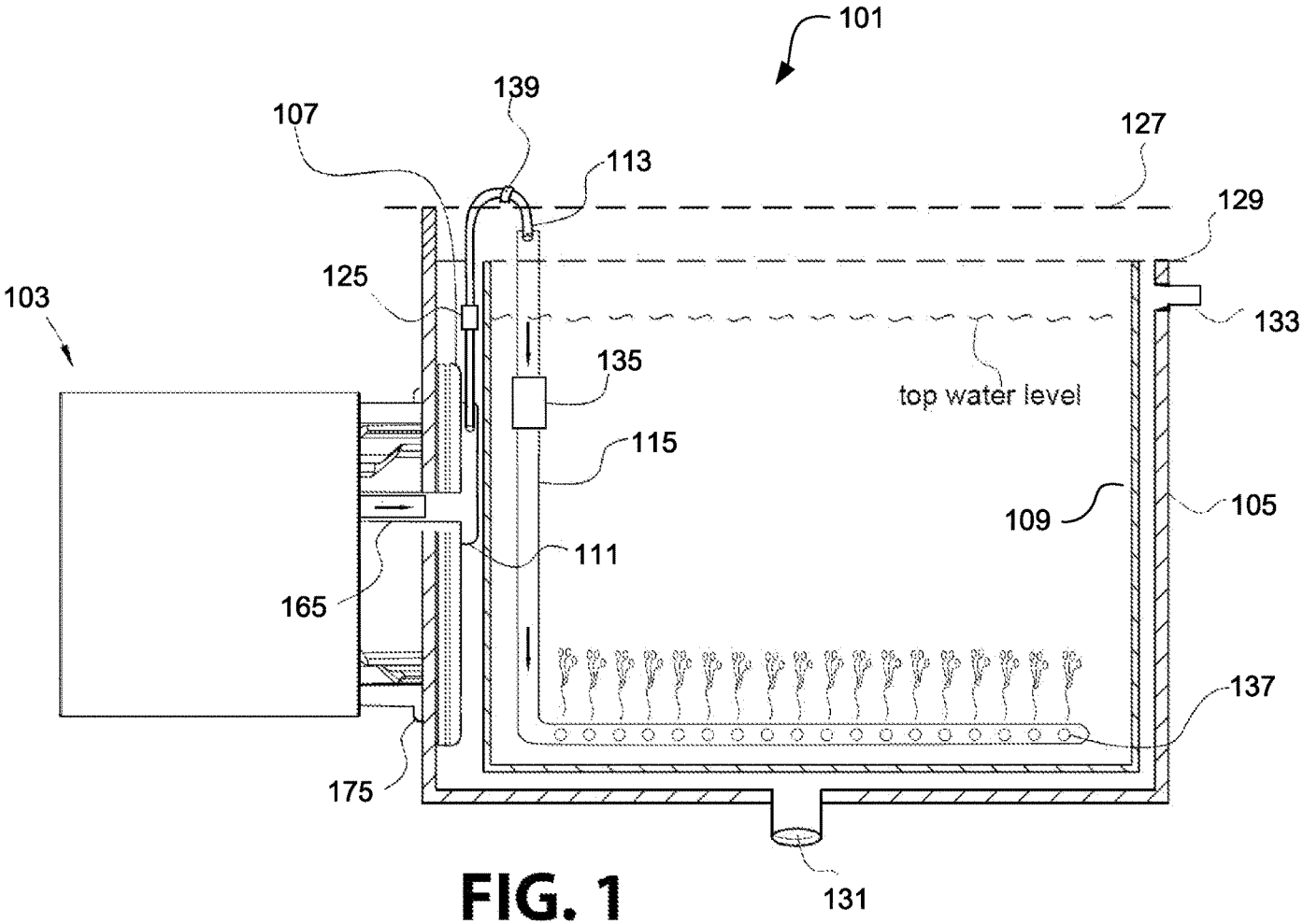
FIG. 1 is a right side, partial cross-sectional, environmental view of a pump assembly of the present application, showing a pump secured to or proximate to a setting, such as an internal wall of a foot spa, while an air nozzle extends into a liner positioned in a foot basin.

While the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the assembly described herein may be oriented in any desired direction.

The invention of the present application overcomes one or more of the above-discussed problems commonly associated with massage chairs and control systems discussed previously. In particular, the present application discloses a pump for generating an air flow for use within a body of water. The pump assembly of the present application is configured to attach to a side wall of a basin of water and generate a flow of air for dispersion into the basin of water. The air pump may connect to the basin and route air through a tube into the basin and dispense the air through a disposable air dispenser. The basin may include a removable liner. Additionally, the pump may include a contactless sensor. These and other unique features of the system are discussed below and illustrated in the accompanying drawings.

The system and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

Referring now to the Figures wherein like reference characters identify corresponding or similar elements in form and function throughout the several views. The following Figures describe the assembly of the present application and its associated features. With reference now to the Figures, embodiments of the present invention are herein described. It should be noted that the articles "a", "an", and "the", as used in this specification, include plural referents unless the content clearly dictates otherwise.

Figure 2:
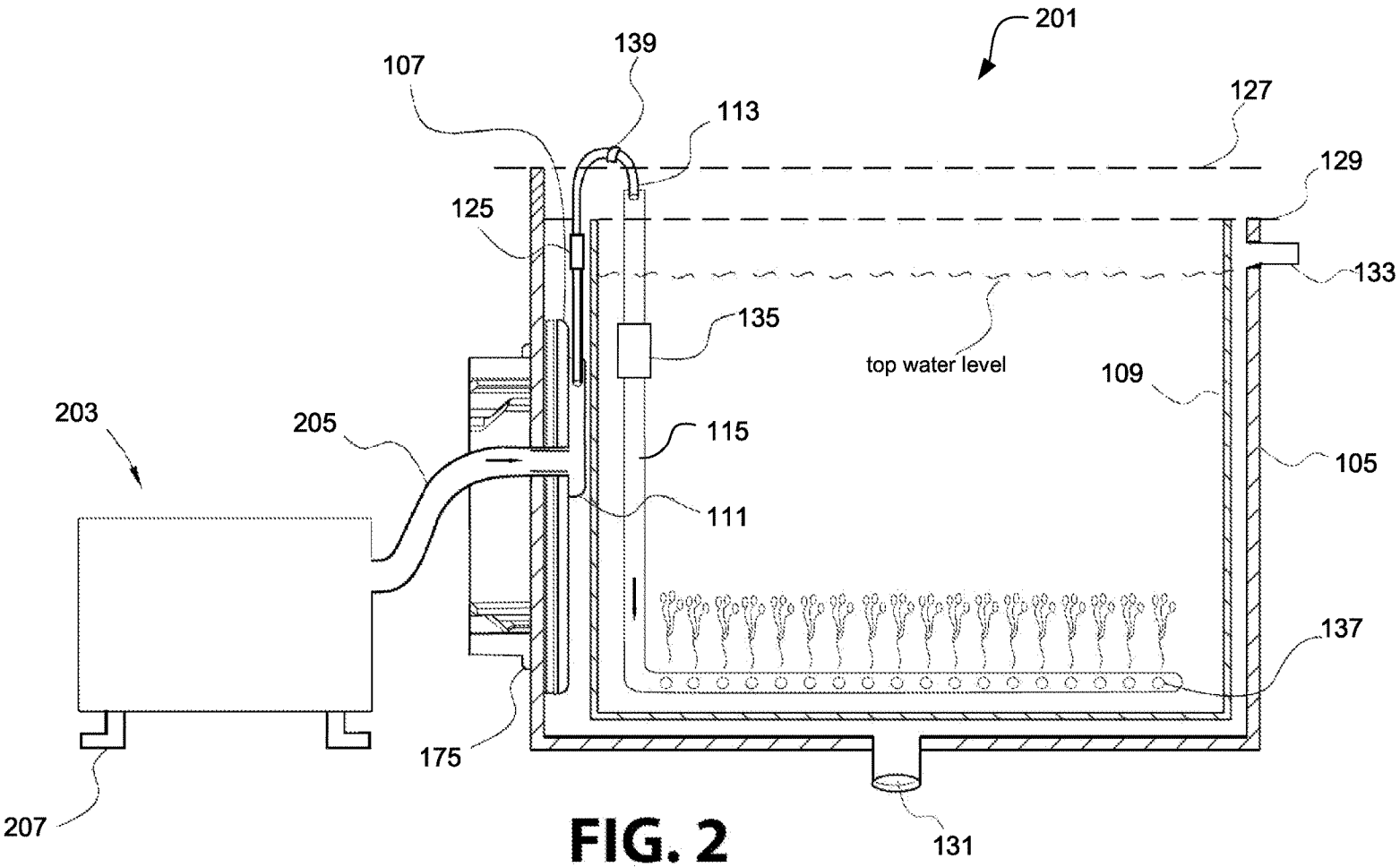
FIG. 2 is a right side view of an alternate embodiment of the pump assembly of FIG. 1.

Referring now to FIGS. 1 and 2 in the drawings, a right side, partial cross-sectional, environmental view of a pump 103 and pump assembly 101 according to the present application is illustrated. In the Figures, pump 103 is secured to or proximate to a basin, such as an external/internal wall of a foot spa, while an air nozzle extends over and into a disposable liner 109 positioned in a foot basin 105. Air is dispersed in the water through the disposable air dispenser 115. Basin 105 is not meant to be limited to a foot spa only but may also be a spa, a jacuzzi, a bathtub, or a swimming pool for example.

As seen in FIG. 1, assembly 101 includes air pump 103 coupled to foot basin 105 through the use of an air pump mounting housing 107. Housing 107 includes a passageway for the traveling of air through a nozzle adapter 111 wherein an air nozzle 113 routes air to an air dispenser 115 for dispersion into the water. Dispenser 115 is located within liner 109 and is submerged within the water.

As seen in FIG. 2, an alternate embodiment of pump assembly 101 is shown. In FIG. 2, pump assembly 201 is shown in a similar manner as pump assembly 101. Assembly 201 is similar in form and function to assembly 101 except as herein identified wherein pump 103 is configured to instead be operative remotely from basin 105. Pump 203 is similar in form and function to pump 103 and is operated remotely by extending an air tube 205 between housing 107 and pump 203. Pump 203 may then include one or more mounting legs 207. The remote operation of pump 203 allows it to be useful in working with multiple styled basins, baths, containers, and so forth outside the realm of mainstream foot spas. The disclosure of assembly 101 will apply equally to that of assembly 201 in FIG. 2.

Figure 3:
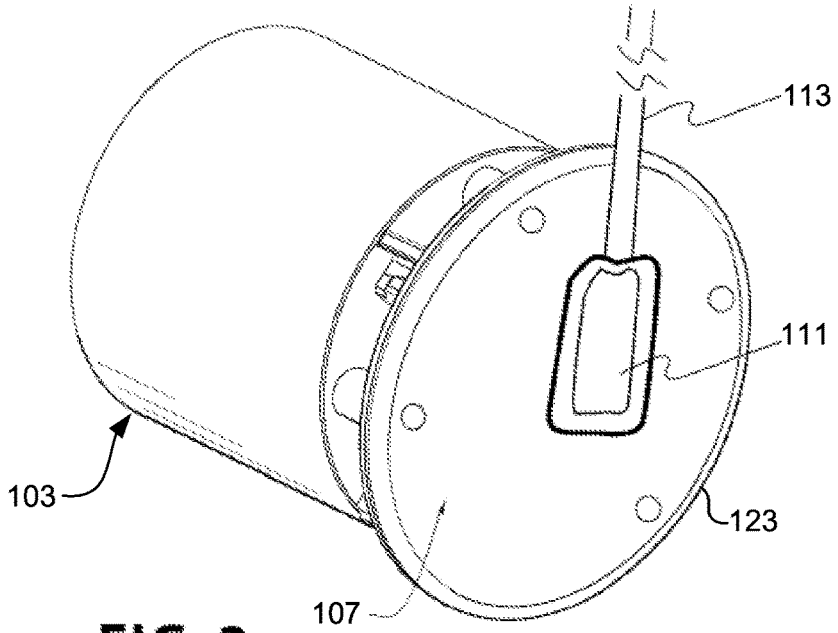
FIG. 3 is a front perspective view of an air pump in the pump assembly of FIG. 1.
Figure 4:
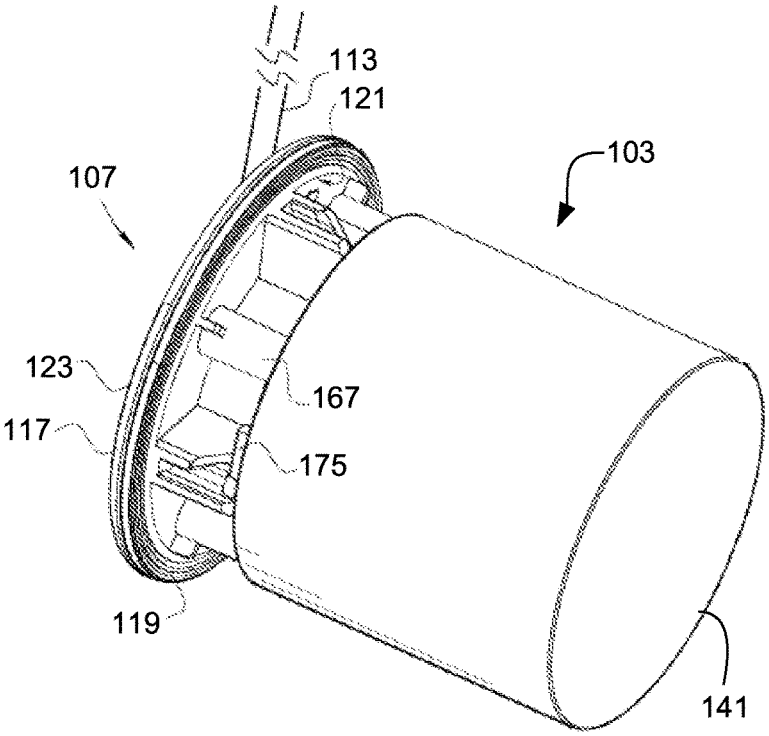
FIG. 4 is a rear perspective view of the air pump of FIG. 3.

Referring now also to FIGS. 3 and 4 in the drawings, front and rear perspective views of pump 103 are illustrated. Housing 107 is configured to provide an attachment point for pump 103 on a side wall of basin 105. Housing 107 includes a shoulder 117 located at an outer most portion of a flange that extends radially outward to a circumference larger than pump 103. Shoulder 117 is located internally within basin 105 when fully assembled with the main body of housing 107 passing through an aperture in basin 105 for connection with pump 103.

A seal 119 is located along a bottom surface 121 of housing 107. Seal 119 creates an air tight and water tight seal between housing 107 and basin 105 so as to prevent any leak which may develop. Seal 119 is preferably a ring-shaped or ring-type gasket which acts or serves as a fluid or water seal to prevent fluid or water from getting past the contact surface of basin 105. Seal 119 is secured to and positioned below (or behind) and adjacent to the rear or bottom side 121 of the mounting housing 107. Preferably, the gasket seal 119 is made or manufactured of a rubber material.

As seen in FIG. 3, a front view of housing 107 is shown. Housing 107 has a top surface 123 (front face) opposite bottom surface 121. Air nozzle adapter 111 is coupled to top surface 123. Air nozzle 113 extends outward from adapter 111. Air leaving pump 103 passes through housing 107, through adapter 111 and into nozzle 113. In FIG. 1, a side view is partially sectioned to show adapter 111 and nozzle 113. An air nozzle extension 125 is optionally used to help in lengthening nozzle 113 so as to adapt to size and fit requirements of basin 105. Nozzle extension 125 is a tubular member that extends over ends of nozzle 113 where nozzle 113 is composed of 2 or more distinct tubes. The length of nozzle extension 125 is not limited to any particular length, only that it is sized according to the needs at the time of use.

From FIGS. 1 and 2 is it seen that nozzle 113 extends up and over disposable liner 109. Liner 109 is a device that is sized similarly to that of basin 105 and is used as a disposable protector to hold a quantity of water. Liner 109 helps to provide proper or adequate hygiene for customers or users. Preferably, the disposable liner 109 is made or manufactured of a plastic material or any other material known to one of ordinary skill in the art. If the liner 109 is not a disposable version, then it is preferred that the liner 109 is made or manufactured of a material that is easily washed or cleaned, or any other material known to one of ordinary skill in the art.

During use, a user would place a portion of their body in basin 105, and in particular within liner 109, where it would be partially submerged in a volume of water or liquid. When the user is done, the water could be drained and the liner may be removed and discarded. Basin 105 may then receive a secondary liner in place of the one just used. In this manner, the liners help maintain sanitary practices wherein multiple users are realized. As a non-limiting example, the liner 109 may be included with the air dispenser 115.

Figure 8:
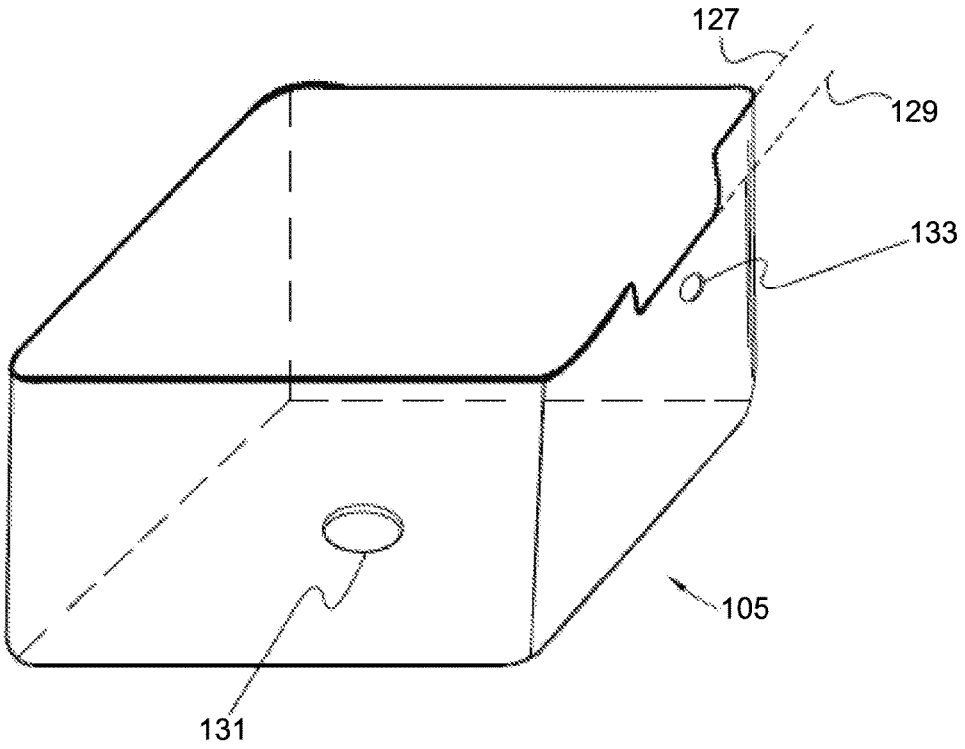
FIG. 8 is a perspective view of the basin of FIG. 1.

Referring now also to FIG. 8, a perspective view of basin 105 is illustrated. Basin 105 is made from any known conventional material sufficient to support a volume of water. Basin 105 includes a plurality of sides and a base that are each coupled or formed together to define a volume. Basin 105 includes a top rim 127 defining an upper level of water and a lower rim 129 defining a lower level of water. Lower rim 129 is formed on one side, but is able to be formed on multiple sides if necessary. Liner 109 resides within the volume of space within basin 105. Ideally liner 109 is of a height equal to lower rim 129. Liner 109 may be other heights between lower rim 129 and upper rim 127. Water is filled inside of liner 109. As a user inserts a portion of their body into the volume of water, water may overflow liner 109. Overflow may pass between liner 109 and basin 105 and flow down to drain hole 131 where it drains away from basin 105. A connector may be coupled to hole 131 for communication with a drainage system. As an option, an over flow preventer mounting hole 133 may be included on basin 105. Water would be routed through hole 133 if the water level got too high and hole 131 was not either operable or included with basin 105.

Figure 7A:
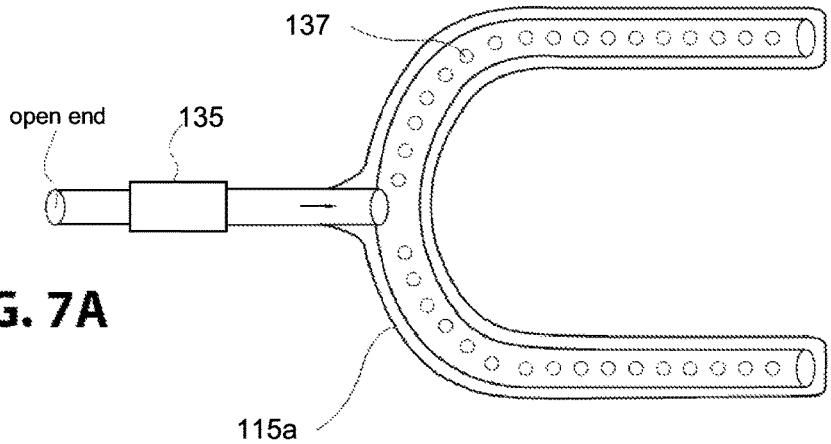
FIGS. 7A-7C are top views of exemplary air dispensers for use with the pump assembly of FIG. 1.
Figure 7B:
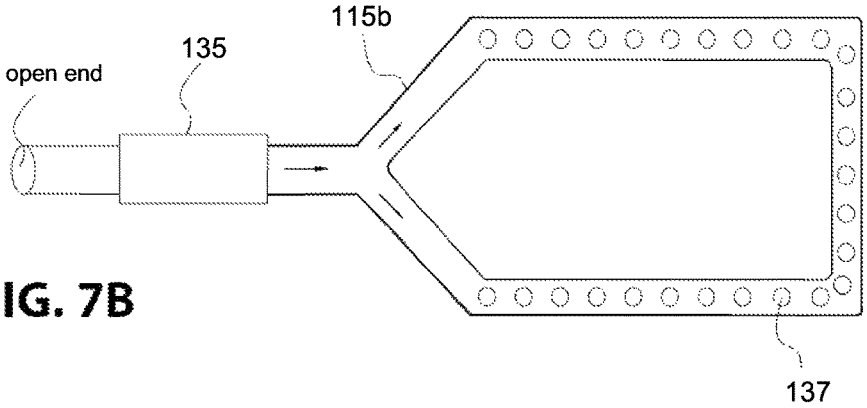
Figure 7C:
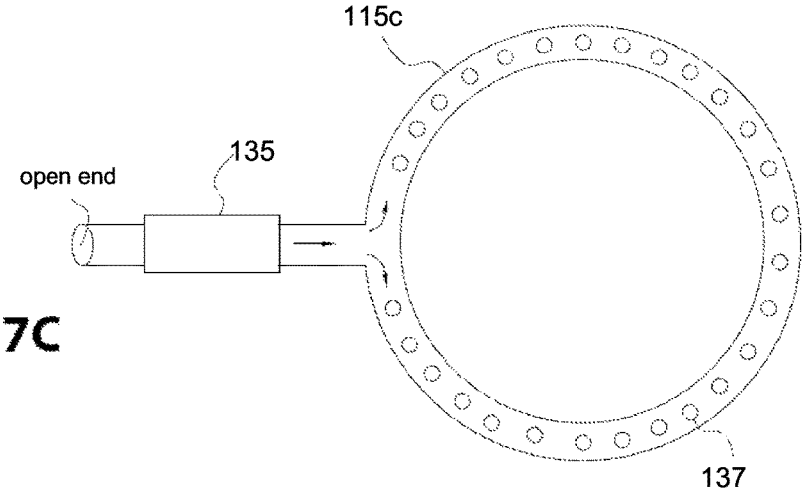

Referring now also to FIGS. 7A-7C in the drawings, top views of exemplary embodiments of air dispenser 115 are illustrated. Dispenser 115 extends into liner 109 from the end of air nozzle 113. As the size and depth of liner 109 and basin 105 may be different, assembly 101 may include an air dispenser extension 135. Extension 135 is similar in form and function to that of extension 125 for use with nozzle 113. Air passes through nozzle 113 and into dispenser 115. The communication point between nozzle 113 and dispenser 115 is ideally above the water lever in liner 109. This helps to prevent water from breaching any connection thereat. As seen in FIGS. 1 and 2, the connection point between the two may be between rims 127 and 129. In another embodiment, the connection point may be above rim 127.

Dispenser 115 includes a series of air holes or ports 137 configured to dispense air. The profile or layout of dispenser 115 may vary and can dictate a particular distribution pattern in liner 109. As seen in FIGS. 7A-7C, different embodiments of dispenser 115 are illustrated, each having a different distribution pattern. With respect to FIG. 7A, dispenser **115*a* is shown wherein the air is routed to two separate appendages which are formed in the shape of a "U". The main line of dispenser 115*a* is at the base of the "U" shape permitting air to travel to either appendage. In FIG. 7B, dispenser 115*b* is shown wherein the air is routed to two appendages that are formed into a rectangular loop. The air in each appendage is communicable with the air in the other appendage. For FIG. 7C, dispenser 115*c* is shown in a similar nature to that of dispenser 115*b* wherein a loop is formed. Dispenser 115*c* differs in that the loop formed is circular as opposed to rectangular as seen in FIG. 7B. From the figures, dispenser 115 may include a plurality of appendages and incorporate different shapes to generate a fully looped air system or one or more closed appendages. Dispenser 115 is not limited to these depicted embodiments but may take other forms including a linear single appendage routing. It is recognized that the inner surface of the base of basin 105 may have grooves (not show) for siting air dispenser 115** therein.

It is understood that air passes outward into the water through air holes 137. In order to prevent backflow from entering dispenser 115 and passing through nozzle 113 to pump 103, a bending section is used to prevent fluid to flow back to the air pump as nozzle 113 bends over an edge of liner 109. Additionally, a backflow preventer 139 may be used. Preventer 139 may be located in nozzle 113 or in the tubing of dispenser 115.

Figures 5, 6:
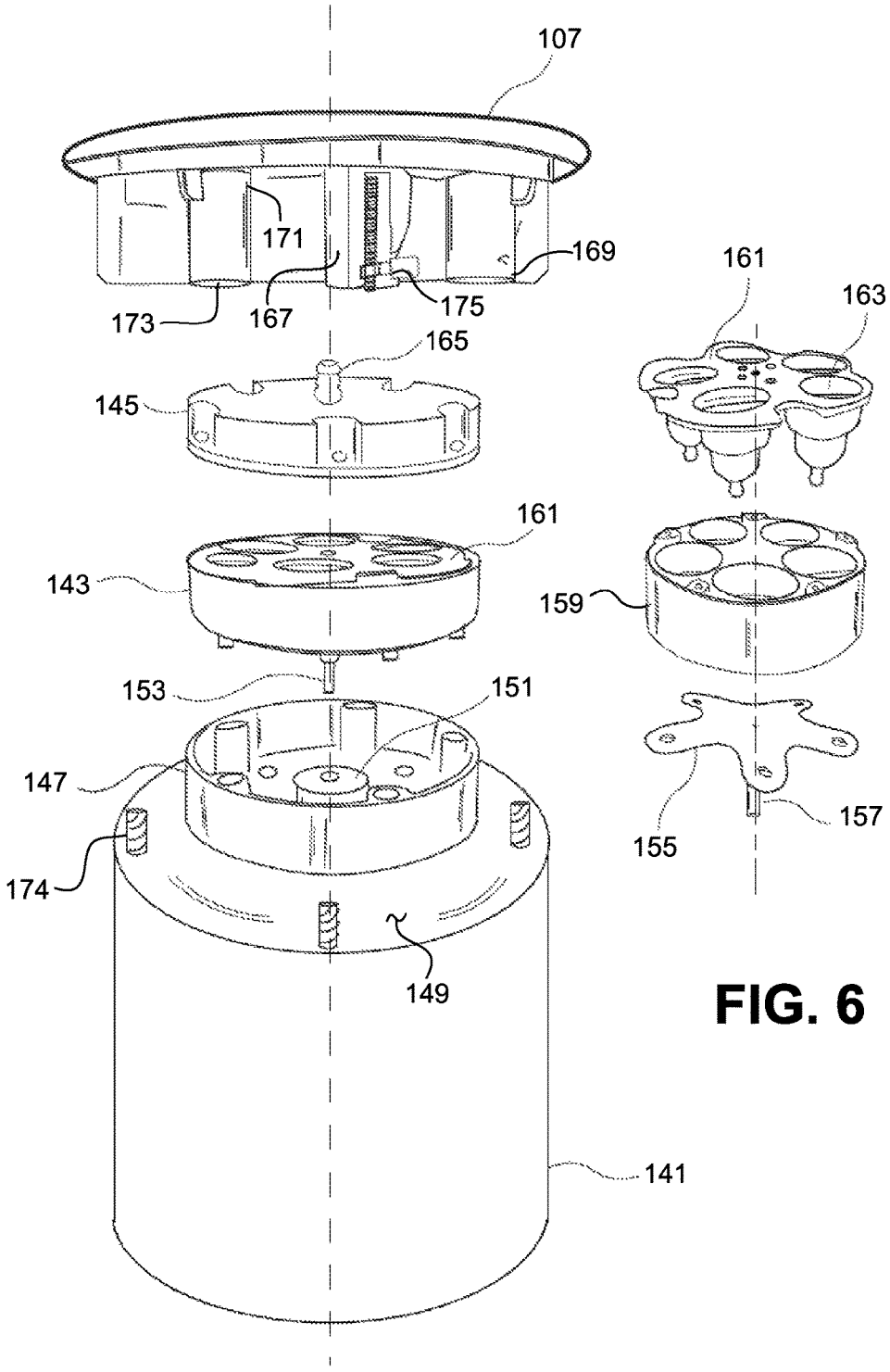
FIG. 5 is an exploded perspective view of the pump of FIG. 3.
FIG. 6 is an exploded perspective view of an air generator in the pump of FIG. 5.

Referring now also to FIGS. 5 and 6 in the drawings, partially exploded views of pump 103 are illustrated. Pump 103 includes a motor 141 operable with either AC or DC current and is configured to generate a compressed flow of air for dispenser 115. Pump 103 further includes an air generator 143 and an air collector 145. Around the casing of motor 141 is a holder 147 for the air generator 143. Holder 147 extends outward along the axis of motor 141 along face 149. A plurality of hole locations are located around the perimeter, used to hold air collector 145 and air generator 143 partially within holder 147. A motor shaft 151 is externally accessible from motor 141 for communication with shaft 153 of generator 143. Generator 143 seats within holder 147.

Generator 143 includes an air diaphragm holder 155 with a shaft 157. This is located beneath the air generator housing 159 along an inner surface of generator 143. Shafts 157 and 153 are in communication with one another. Resting within housing 159 is an air diaphragm 161 with a plurality of air chamber 163. Chamber 163 pass into hollowed cutouts in housing 159. Air is generated by operating the diaphragm 161 to produce an airflow. The airflow passes through generator 143 and through collector 145 via air pump outlet 165. Nozzle 113 is in fluid communication with the air flow exiting outlet 165.

Each of collector 145 and generator 143 nestle within holder 147 to facilitate mating with housing 107. Housing 107 includes a plurality of mounting legs 167. Each of the plurality of mounting legs 167 has a first end 169, a second end 171, and a hollow channel 173 extending from the first end 169 toward the second end 171. Each hollow channel 173 is dimensioned and configured for receiving a corresponding screw 174 of a plurality of screws when the pump 103 is to be secured to the mounting housing member 107. Preferably, the wing nut 175 rotates to extend out to provide a lock for the securement or installation of the housing 107 to the basin 105. The plurality of screws and wing nut 175 secure or attach the housing 107 and motor pump 103 to one another when the user screws or tightens the screws into the hollow channel 173 of the mounting legs 167 and rotates the wing nut 175. The tightening of the screws into the hollow channel 173 of the mounting legs 167 and rotation of the wing nut 175 causes pressure to be applied to the gasket or seal 119 and shoulder 117 such that a strong seal will form between the gasket or seal 119 and contact surface of basin 105.

It is understood that a number of components or parts of assembly 101/201 have been discussed. It is known that any of housing 107, basin 105, liner 109 and other components in the assembly 101/201 may be made or manufactured of plastic, hard plastic, and/or any other suitable material known to one of ordinary skill in the art. Some parts may need flexibility as seen with nozzle 113 and potentially portions of dispenser 115, and in such situations, more rubber or flexible elastomeric materials may be substituted.

Figure 9:
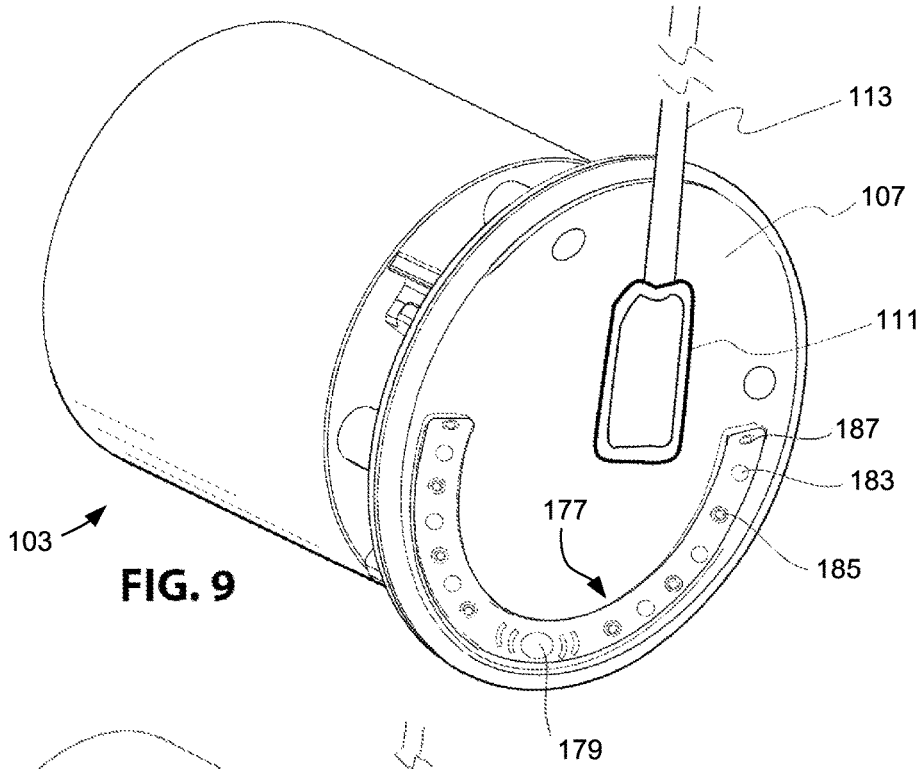
FIG. 9 is a front perspective view of the air pump of FIG. 3 with a contactless fluid sensor, LED lights, and infrared lights.
Figure 10:
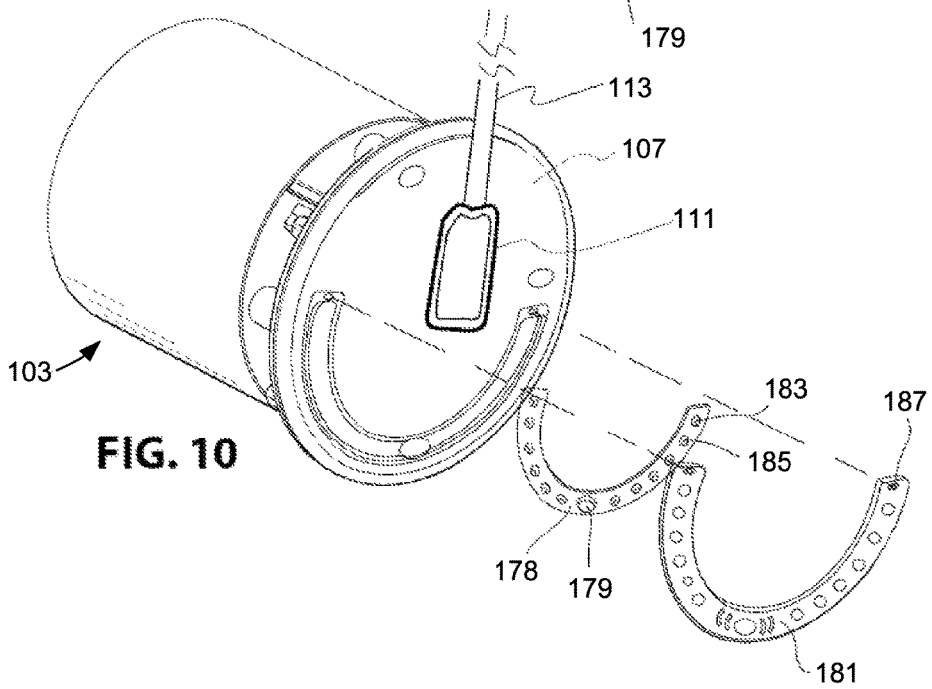
FIG. 10 is a partial exploded perspective view of the air pump of FIG. 9.

Referring now also to FIGS. 9 and 10 in the drawings, front perspective views of air pump 103 and housing 107 are illustrated. The combination of pump 103 and housing 107 may further include a contactless fluid sensor assembly 177 that has a contactless fluid sensor 179 or sensor circuit board 178, and a sensor cap 181. The contactless, fluid sensor assembly 177 is secured, attached, fixed or mounted to top surface 123 of housing 107. Preferably, the contactless, fluid sensor 179 is a contactless capacitive fluid sensor. It is obvious to one of ordinary skill in the art that the contactless fluid sensor 179 can be secured, attached, fixed or mounted to any position on the other components of the pump 103 and housing 107, or even be positioned at a location away from the pump 103, that allows the contactless fluid sensor 179 to be in operative communication with the other components of the pump 103 whereby the contactless fluid sensor 179 is effective, especially when a liner 109 is being used in or with basin 105. Contactless fluid sensor 179 may operate with capacitive sensing of fluid or water levels within basin 105 such that the amount or volume of fluid or water can be controlled. The contactless fluid sensor 179 preferably includes a plurality of connections for data wiring and an electronic circuit for capacitive sensing of fluid or water level such that the amount or volume of fluid or water within liner 109 can be controlled when liner 109 is being used. When in use or operation, liner 109 is positioned at a distance from basin 105 and does not permit the fluid from making contact with the contactless fluid sensor 179.

Sensor 179 may also be configured with wiring communicating it with other electronic devices, such as sensor circuit board 178. Board 178 is configured to regulate the operation of other devices, such as light 183 and infrared light 185. Light 183 is ideally suited to be an LED light and used for the purpose of illuminating the water within liner 109. This increases visibility for the users. Infrared light 185 is used to produce heat and sanitization effects on liner 109 and the water. These are useful in regulating temperature of the water.

A cap 181 is secured, attached, fixed or mounted to the contactless, fluid sensor 179, lights 185 and 183, and board 178. Cap 181 provides protection for the contactless fluid sensor 179 and the other electronic devices against fluid or water, chemicals, substances, etc. Preferably, cap 181 is dimensioned and configured to cover all or substantially all of the contactless fluid sensor 179 and the electronic devices. Cap is secured through one or more fasteners (not shown) that pass through a mounting hole 187 and into a corresponding hole in the mounting housing 107. Preferably, cap 181 is made or manufactured of a non-metal material.

Figure 11:
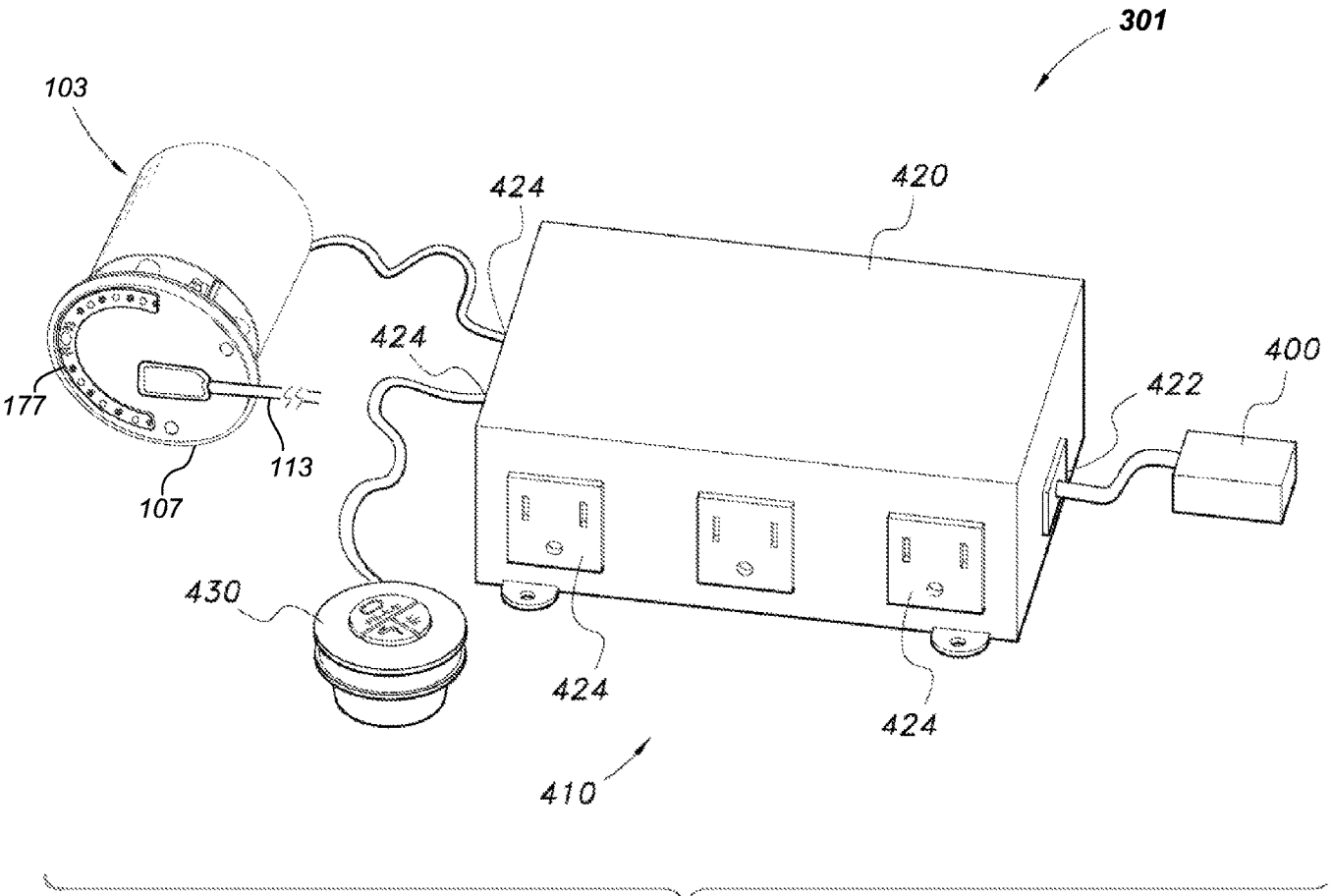
FIG. 11 is a perspective view of a pump assembly according to the present application, showing a pump and a control device or keypad being connected to a control box.
Figure 12:
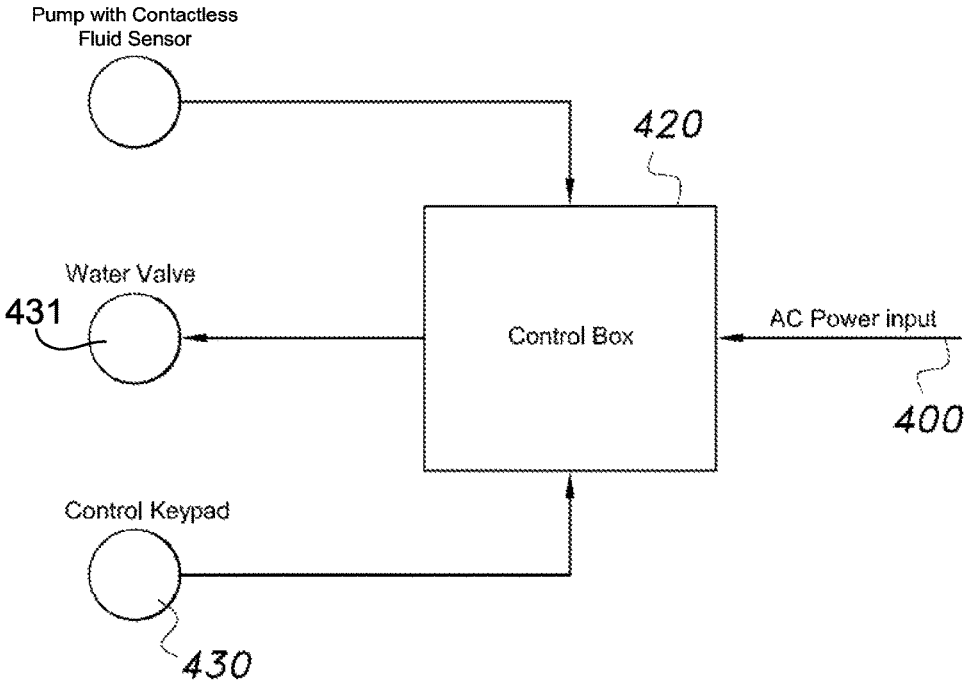
FIG. 12 is a schematic view of the control box of FIG. 11, showing the control box being in operative connection or communication with the pump, a control device or keypad, a fluid valve, and a power source.

Referring now also to FIGS. 11 and 12 in the drawings, a perspective view of pump assembly 301 according to the present application is illustrated along with a perspective view of a control box 420 with the control box being in operative connection or communication with the pump 103, a control device or keypad 430, a fluid valve 431, and a power source 400. In FIG. 11, pump 103 is shown with a control device or keypad being connected to the control box.

Power source 400 provides power to the pump 103, and preferably provides power to the motor 141 of the pump 103 to produce the airflow. As a non-limiting example, the power source 400 may be AC power input, at least one battery, or any power source known to one of ordinary skill in the art.

As shown in FIGS. 11 and 12, the motor 141 may be connected to the power source 400 via the control box 420 of the control apparatus 410.

As shown in FIGS. 11 and 12, the control apparatus 410 preferably includes the control box 420 and a control keypad or device 430. The control box 420 preferably includes at least one inlet 422 for being in operative communication with the power source 400, and multiple outlets 424 for being in operative communication with the pump 103 and control keypad or device 430. The control keypad or device 430 preferably acts as a remote-control device to be able to turn the pump 103 on and off, to adjust how much fluid the fluid or water valve should allow to be added into and/or to be removed or drained from basin 105, etc. In addition, it is preferred that the control keypad or device 430 is operable to control at least one of the intensity, color, illumination sequencing, and any combination thereof for the array of members 183 and 185.

Figure 13:
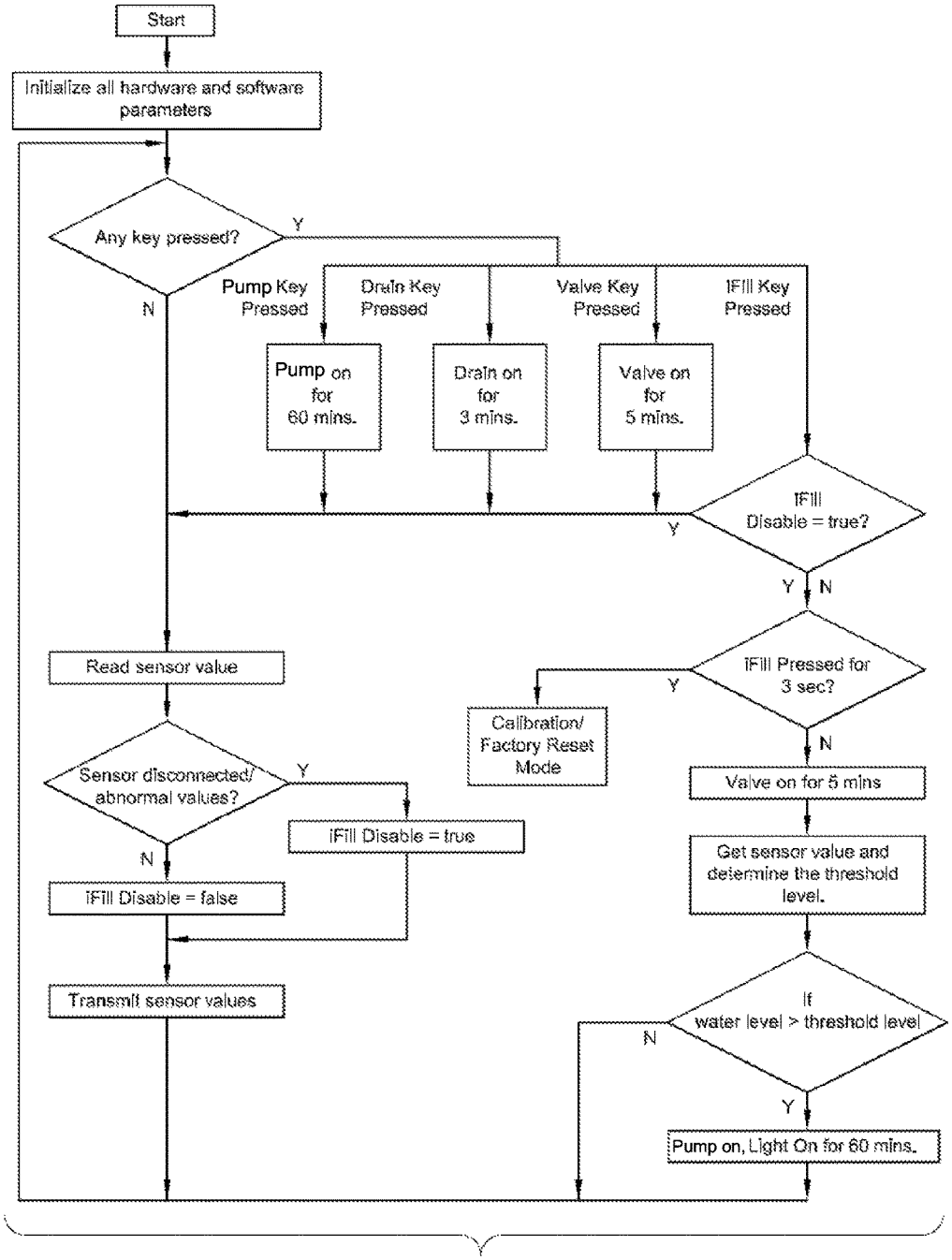
FIG. 13 is a schematic block diagram of an embodiment of controlling fluid or water level in a setting via the use of a pump having a contactless fluid sensor according to the present invention, showing the relationships or associations of various components, such as a control keypad or device being in operative connection or communication with the pump, a control box, a fluid valve, and a power source.

Referring now also to FIG. 13 in the drawings, a schematic block diagram of an embodiment of controlling fluid or water level via the use of a pump having a contactless fluid sensor according to the present invention is illustrated. In FIG. 13 the relationships or associations of various components are shown, such as a control keypad or device 430 being in operative connection or communication with the pump 103, a control box 420, a fluid valve 431, and a power source 400. Pump 103 includes contactless fluid sensor 179.

Figure 14:
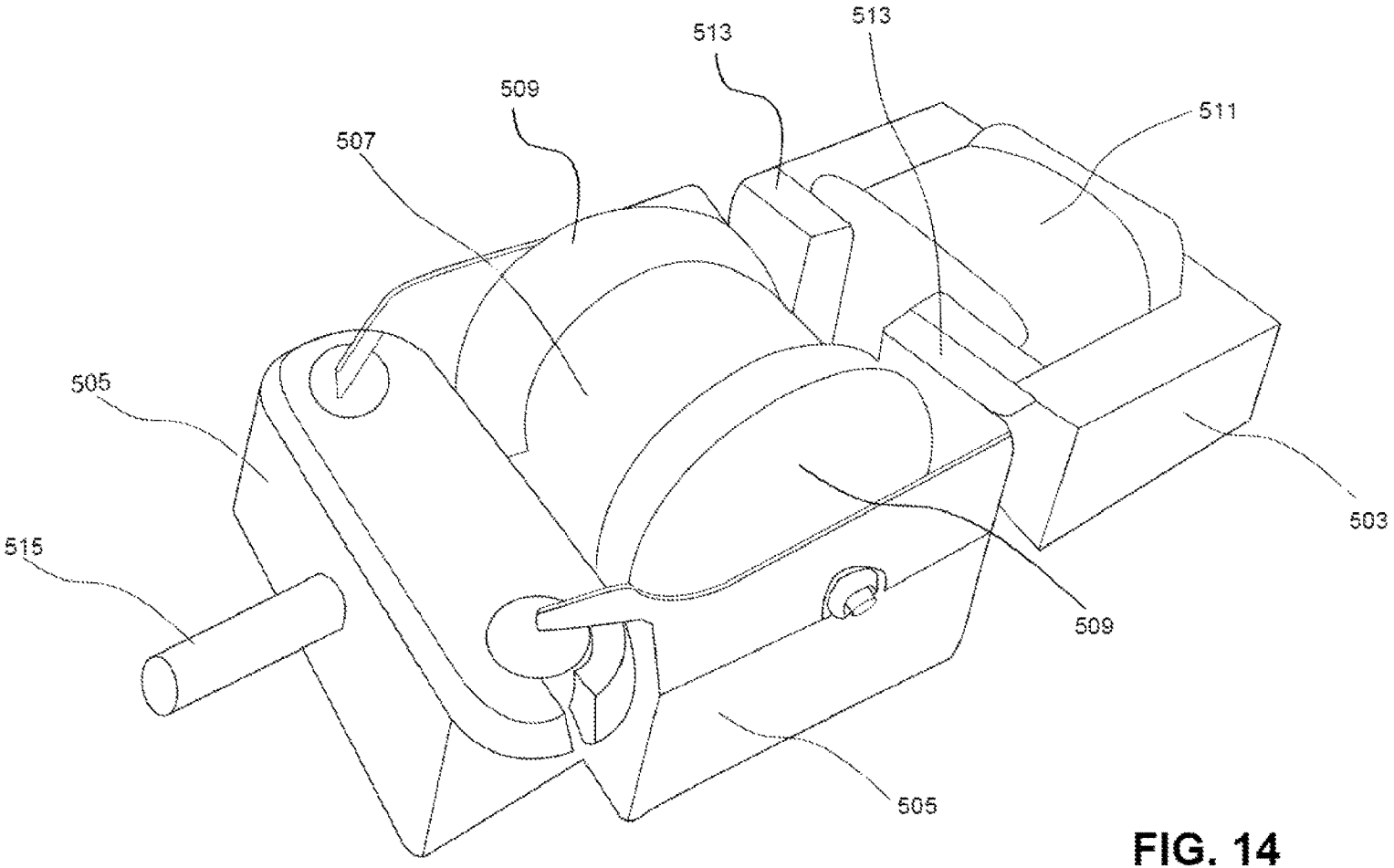
FIG. 14 is a perspective view of an alternate embodiment of the air generator of FIG. 5.

Referring now also to FIG. 14 in the drawings, a perspective view of an alternative embodiment of the air generator 143 is illustrated. Air generator 501 is similar in form and function to that of air generator 143. Generator 501 includes a coil frame 503 and an air collector 505. Air collector 505 houses an air chamber 507 and dual diaphragms 509. A coil 511 and magnetic discs 513 are in communication with coil frame 503. Air leaves air collector 505 through air pump outlet 515.

It is to be understood that the present embodiments within the invention is not limited to the embodiments described above or as shown in the attached figures, but encompasses any and all embodiments within the spirit of the invention.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. An air pump assembly for dispensing air to a setting or work environment in manicure and pedicure industries, said air pump assembly comprising:

an air pump for creating air flow, wherein the air pump is designed and configured to be mounted on a sidewall of a foot basin; and a mounting housing comprising a top surface, a bottom surface, an air nozzle, and a shoulder dimensioned and configured to mount to the sidewall of a foot basin in the manicure and pedicure industries;

wherein said top surface of the mounting housing is connected to an air pump outlet of said air pump and said air nozzle extending from the top surface of the mounting housing to dispend air generated by the air pump into the foot basin.

2. The air pump assembly according to claim 1, wherein said mounting housing further comprises at least one Light Emitting Diode light.

3. The air pump assembly according to claim 1, wherein said mounting housing further comprises at least one infrared light.

4. The air pump assembly according to claim 1, wherein said air pump further comprises at least one air generator.

5. The air pump assembly according to claim 4, wherein said at least one air generator comprises at least one air diaphragm.

6. The air pump assembly according to claim 5, wherein said at least one air diaphragm comprises at least one air chamber.

7. The air pump assembly according to claim 1, wherein said mounting housing further comprises a contactless sensor.

8. The air pump assembly according to claim 1, wherein said air nozzle further comprises a bending section to prevent fluid to flow back to the air pump.

9. The air pump assembly according to claim 1, wherein said air pump includes at least one air collector which further comprises at least one air outlet.

10. The air pump assembly according to claim 1, wherein said air nozzle further comprises at least one backflow preventer.

11. An air pump assembly for dispensing air to a setting or work environment in manicure and pedicure industries, said air pump assembly comprising:

an air pump for creating air flow;

a mounting housing comprising a top surface, a bottom surface, an air nozzle, and a shoulder dimensioned and configured to mount to a sidewall of a basin in the manicure and pedicure industries, said top surface of the mounting housing is connected to an air pump outlet of said air pump and said air nozzle extending from the top surface of the mounting housing to dispend air generated by the air pump into the basin; and a disposable air dispenser connected to said air nozzle to distribute air to a foot basin.

12. The air pump assembly according to claim 11, wherein said mounting housing further comprises at least one mounting leg.

13. The air pump assembly according to claim 12, wherein said at least one mounting leg is dimensioned and configured for receiving a wing nut.

14. The air pump assembly according to claim 11, wherein said air pump further comprises at least one air generator.

15. The air pump assembly according to claim 14, wherein said at least one air generator comprises at least one air diaphragm.

16. The air pump assembly according to claim 15, wherein said at least one air diaphragm comprises at least one air chamber.

17. The air pump assembly according to claim 15, wherein said at least one air diaphragm is made from rubber.

18. The air pump assembly according to claim 11, wherein said air pump further comprises at least one air collector.

19. The air pump assembly according to claim 18, wherein said at least one air collector further comprises at least one air outlet.

20. The air pump assembly according to claim 11, wherein said disposable air dispenser comprises multiple air holes.

21. A pedicure spa basin, comprising:

a spa basin comprising an air pump assembly and a drain hole, wherein the air pump assembly includes:

an air pump for creating air flow;

a mounting housing comprising a top surface, a bottom surface, an air nozzle, and a shoulder dimensioned and configured to mount to a sidewall of the spa basin in manicure and pedicure industries, said top surface of the mounting housing is connected to an air pump outlet of said air pump and said air nozzle extending from the top surface of the mounting housing to dispend air generated by the air pump into the spa basin, and a disposable air dispenser connected to said air nozzle to distribute air to the spa basin.

22. The pedicure spa basin according to claim 21, further comprising a disposable liner wherein disposable liner is placed between the mounting housing and the disposable air dispenser.

23. The pedicure spa basin according to claim 21, further comprising at least one overflow preventer device.

24. The pedicure spa basin according to claim 21, further comprising at least one lower level portion for second overflow protection.

25. The pedicure spa basin according to claim 21, wherein the air pump further includes at least one air generator.

26. The pedicure spa basin according to claim 21, wherein said mounting housing further comprises a contactless sensor.

27. The pedicure spa basin according to claim 21, wherein said mounting housing further comprises at least one Light Emitting Diode light.

28. A pedicure spa basin, comprising:

a spa basin comprising an air pump assembly and a drain hole, wherein the air pump assembly includes:

an air pump for creating air flow; and a mounting housing comprising a top surface, a bottom surface, an air nozzle, and a shoulder dimensioned and configured to mount to a sidewall of the spa basin in manicure and pedicure industries, wherein said top surface of the mounting housing is connected to an air pump outlet of said air pump and said air nozzle extending from the top surface of the mounting housing to dispend air generated by the air pump into the spa basin.

29. The pedicure spa basin according to claim 28, further comprising a disposable air dispenser to distribute air to the spa basin.

30. The pedicure spa basin according to claim 28, further comprising at least one overflow preventer device.

* * * * *